US007111351B1

(12) United States Patent
DeRoma

(10) Patent No.: US 7,111,351 B1
(45) Date of Patent: Sep. 26, 2006

(54) LINT ROLLER HANDLE AND COVER

(76) Inventor: Flavio DeRoma, 400 Corporate Dr., Blauvelt, NY (US) 10913

( * ) Notice: Subject to any disclaimer, the term of this patent is extended or adjusted under 35 U.S.C. 154(b) by 0 days.

(21) Appl. No.: 11/105,630

(22) Filed: Apr. 13, 2005

(51) Int. Cl.
*A47L 25/00* (2006.01)

(52) U.S. Cl. ..... 15/104.002

(58) Field of Classification Search ..... 15/104.002, 15/184
See application file for complete search history.

(56) References Cited

U.S. PATENT DOCUMENTS

D162,156 S * 2/1951 Green ..... D4/122
2,542,774 A * 2/1951 Hutchinson ..... 15/104.002
2,658,217 A * 11/1953 Green ..... 15/104.002
3,381,325 A * 5/1968 Reineman ..... 15/104.002
3,421,170 A * 1/1969 Thomas, Jr. ..... 15/104.002
3,623,179 A * 11/1971 Roth ..... 15/104.001
4,257,616 A * 3/1981 Pless ..... 15/230
4,361,923 A * 12/1982 McKay ..... 15/104.002
4,979,257 A * 12/1990 Heneveld ..... 15/104.002
5,333,341 A * 8/1994 Heneveld ..... 15/104.2
2003/0089632 A1* 5/2003 Jessen et al. ..... 206/389
2005/0183223 A1* 8/2005 Cheng ..... 15/104.002

* cited by examiner

*Primary Examiner*—Randall Chin
(74) *Attorney, Agent, or Firm*—Stephen E. FeldmanP.C

(57) ABSTRACT

A lint roller which includes a handle, a roller, a roller support section located on an inner part of said handle, an adhesive tape roll and a cover arranged to interconnect with the handle. The cover provides protection for the adhesive tape roll preventing the adhesive tape roll from unintentionally sticking to anything other than an intended object or material.

14 Claims, 3 Drawing Sheets

LINT ROLLER HANDLE AND COVER

FIELD OF THE INVENTION

The present invention deals with lint rollers and more specifically, a lint roller assembly encased within a lint roller handle and cover.

BACKGROUND OF THE INVENTION

Lint rollers are well known for use in removing micro-debris such as lint and pet hair, from furniture, linens and clothes. In use, such lint rollers are typically coated with adhesive masking tape sheets wound around a cylindrical core that rotates. When the adhesive tape becomes contaminated with micro-debris, the contaminated adhesive sheet is then peeled off and discarded, readying a subsequent adhesive sheet for more use.

There are several known types and styles of lint rollers. These lint roller assemblies typically comprise a handle secured to a cylindrical lint roller support. A tubular cylindrical adhesive lint roller is then removably mounted to the support such that the adhesive roller is rotatable relative to the handle.

Storing lint rollers when not in use presents a problem because the prior art designs do not provide a cover for the adhesive section. Usually, the adhesive part sticks to the surface on which the roller is resting, and usually to any surrounding objects it may bump into when being moved. The size and shape of typical lint roller also cause problems when storing these items.

When storing these prior art rollers, usually, these rollers end up with either the roller falling over or the adhesive tape sticking to a nearby object. This then brings both the roller and the object it is stuck to, off the shelf upon which it rests. Or if it doesn't fall off the shelf, it will act as a domino and knock everything in the surrounding area over.

SUMMARY OF THE INVENTION

A lint roller having a handle with a mirror-image cover both of which encase a lint roller assembly. That is, the handle and cover are substantially similar. In the preferred embodiment, the lint roller has an oval-shaped handle with a roller and a roller support section. The roller support section is located within the handle. An oval-shaped cover is provided which connects to the handle. The cover provides protection for the adhesive roller to prevent it from unintentionally sticking to anything and taking up less storage space.

In further detail, the lint roller comprises a handle, a roller support section located within the handle, a roller and a cover. The cover is arranged to fit onto the handle and over the roller and roller support section.

In accordance with further aspects of a preferred embodiment, the lint roller further comprises an adhesive tape roll that may be a number of adhesive sheets wound on a core, or a flexible washable plastic substrate of polyvinyl.

The adhesive tape roll is changed by removing the roller support section from the handle and withdrawing the roller from said adhesive tape roll, thereby allowing a new tape roll to be sheathed on the roller.

DETAILED DESCRIPTION

Figure 1:
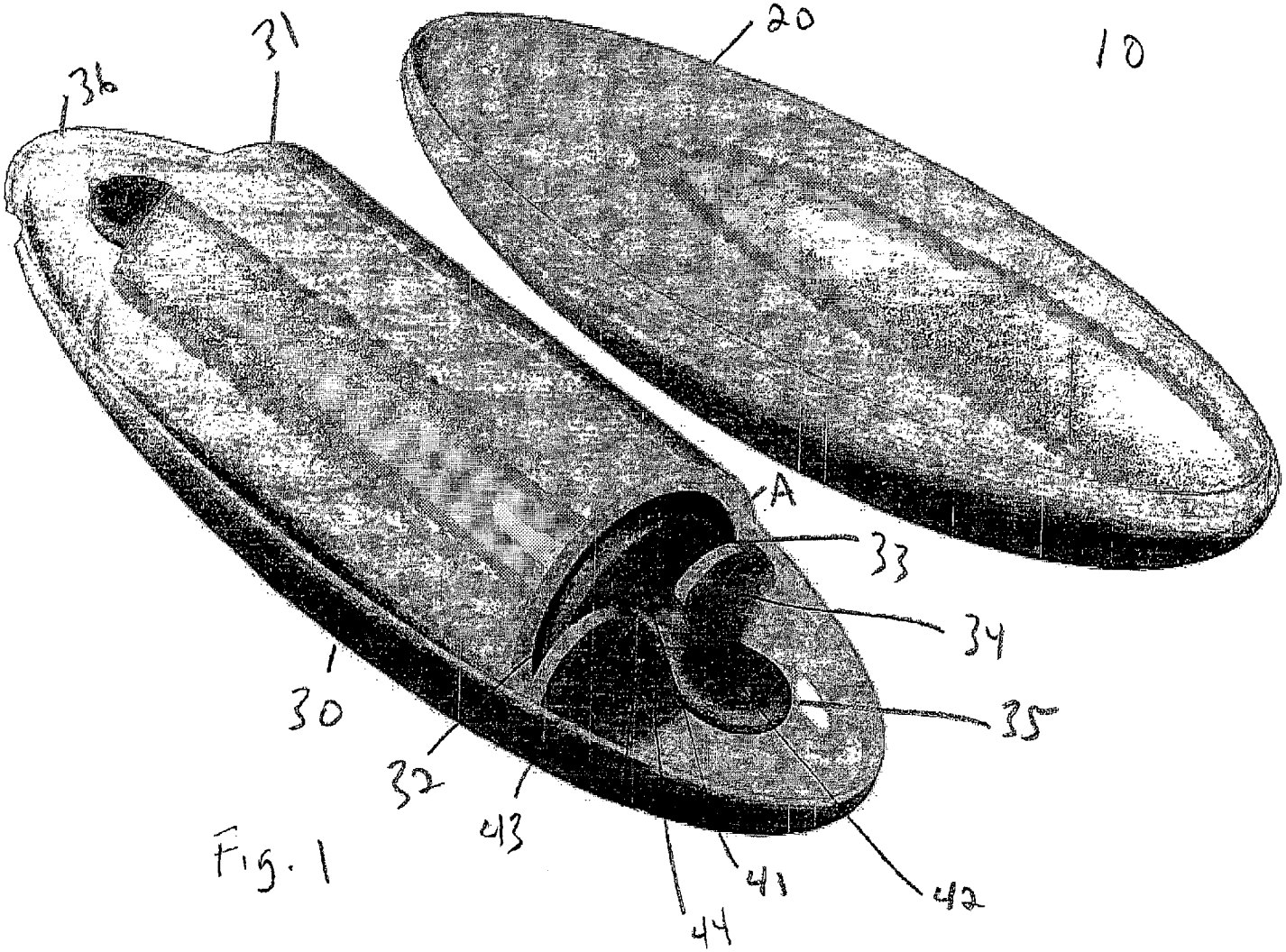
FIG. 1 shows a side view of a lint roller and cover in accordance with an embodiment of the present invention.
Figure 2:
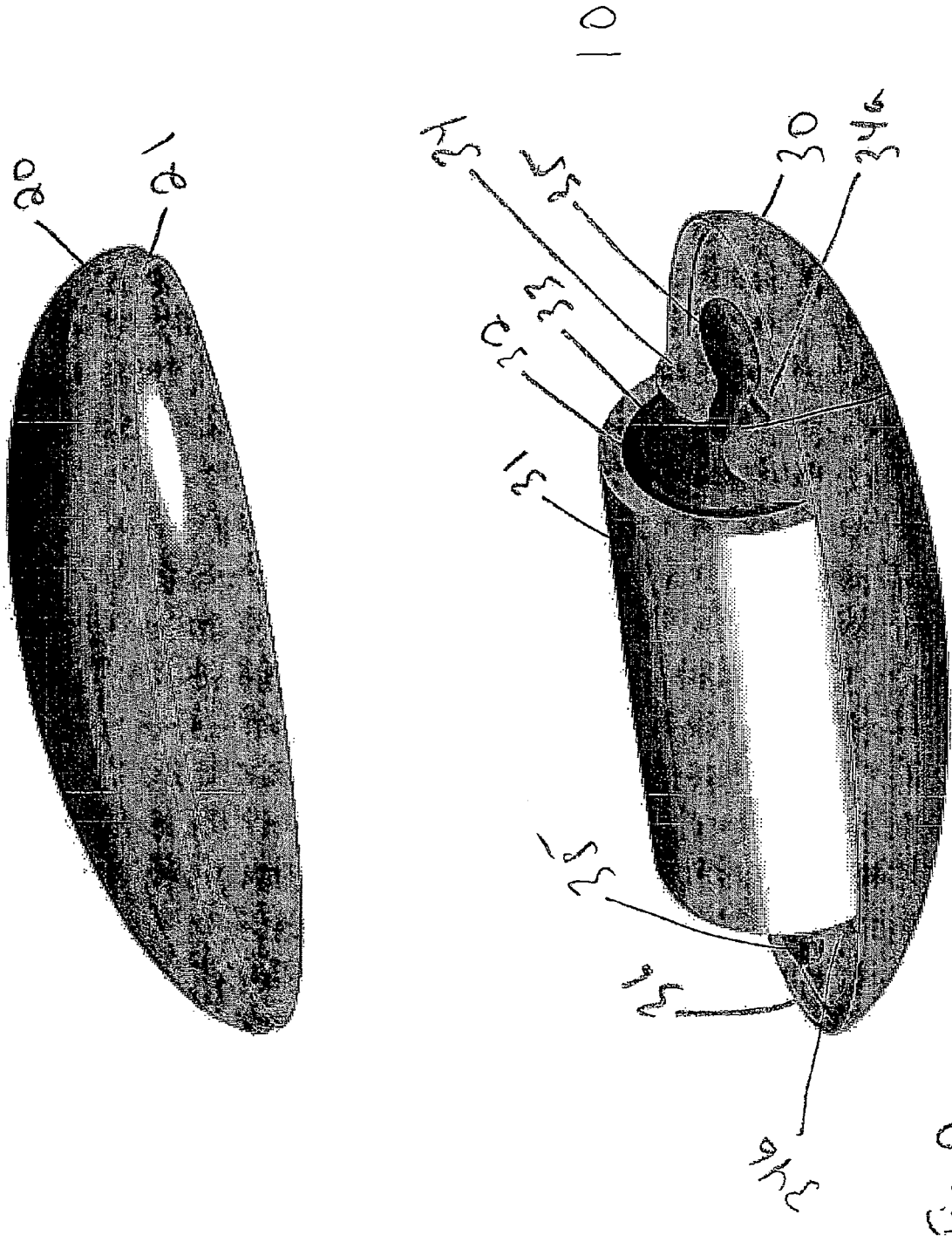
FIG. 2 shows an alternate view of a lint roller and case in accordance with an embodiment of the present invention.

FIGS. 1–2 show a lint roller in accordance with an embodiment of the present invention, generally indicated by reference numeral 10. The lint roller 10 is generally in the shape of an egg. That is, the handle 30 is oval in shape and the cover 20 is oval in shape. The handle 30 and cover 20 fit and interlock with each other thereby forming an egg-shaped lint roller 10 when the lint roller is in a closed position. The egg-shape is an exemplary design and the roller is not limited to this design alone. Other designs may be spheres, cubes, or any other shape where a roller assembly may be encased within a handle.

When the lint roller 10 is in an opened position, an adhesive tape roll 31 along with the roller 33 is rolled along and against a surface to pick up dirt and debris. When in a closed position, the cover 20 provides protection for the adhesive tape roll 31 from sticking to anything. Also, the egg-shaped design allows for easy and convenient storage.

Figure 3:
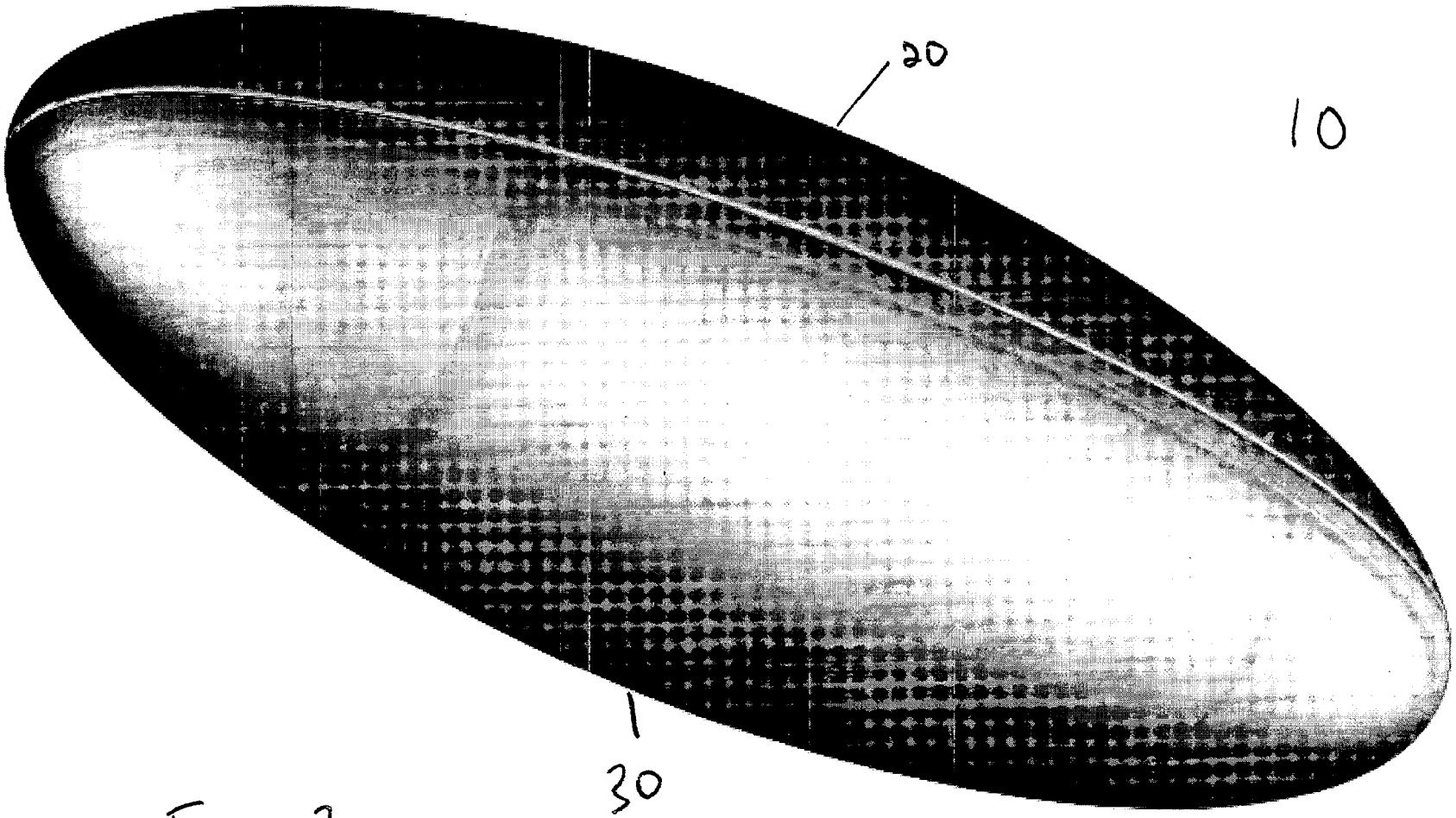
FIG. 3 shows the lint roller of FIGS. 1 and 2 with the cover in a closed position.

In this particular embodiment, the roller 33, the adhesive tape roll 31 and the roller support section 34 fit within the handle 30 and cover 20. In this way, as shown in FIG. 3, when not in use the handle 30 and cover 20 can receive and hold the roller so that the roller 10 takes up less storage space overall and the tape roll 31 is protected from contamination.

The adhesive tape roll 31 and roller 33 are tubular and cylindrical in shape. The adhesive tape roll 31 is slidably received over the roller 33. The roller 33 is retained to the handle 30 by being connected to the roller support section 34 in a manner subsequently described in greater detail.

The roller 33 is generally cylindrical in shape and has a predetermined axial or longitudinal length 20. The support section 34 has two sides 34*a* and 34*b* which are permanently affixed to the inside of the handle 30. The roller 33 has elongated protrusions 35, which extend from the roller, on each end of the roller 33. The distal ends of the roller 33 and the protrusions 35 lie generally along an X-plane. The protrusion 35 extends beyond the roller support section 34 and has a circular portion 42 that is coplanar with the X-plane. These protrusions 35 are removably connected to the roller support section 34. The connection is made by placing the protrusions 35 within the roller support section 34 and locking the protrusions 35 into place.

More specifically, the protrusion 35 has a bottom portion 41 located at its base and a circular portion 42 located on the opposite end. The bottom portion 41 is connected to the roller 33 at point A. The bottom portion's thickness decreases as the shaft 44 of the protrusion approaches the circular portion 42.

The support section 34 is configured so as to accept the bottom portion of the protrusion 41. That is, the bottom portion 41 is received into a groove 43 of the support section 34. The groove 43 is substantially U-shaped or open-ended. The groove 43 is configured to move a certain distance thereby allowing the bottom section of the protrusion 41 to fit into the bottom of the groove 43. Once in place, the groove 43 moves to its original position thereby firmly locking the roller 33 into the support section 34.

By locking the protrusions 35 within the roller support section 34 a user can roll the roller 33 along an article for its intended use without the roller 33 becoming unattached from the handle 30.

With reference now particularly to FIGS. 1 and 2, the lint roller 10 includes a tubular and cylindrical core 32 having an adhesive roll 31 wound about the core 32. This adhesive roll 31 is conventional in construction and includes a backer sheet coated with an adhesive on one side. The adhesive roll 31 may be either continuous or perforated into single sheets wherein the width of each sheet substantially equals the circumference of the adhesive roll 31.

The longitudinal length of the core 32 is substantially the same or slightly less than the longitudinal length of the roller 33. Furthermore, the inside diameter of the core 32 is substantially the same or slightly less than the outside diameter of the roller 33 as defined by the outer surface of the roller 33.

In order to mount the adhesive roll 31 to the roller, the roller 33 is removed from the handle 30 as discussed above. The adhesive roll 31 is then pushed over the roller 33. The diameter of the roller 33 is smaller than the circumference of the adhesive roll 31 but of a size as not to allow free rotation of the adhesive roll 31 relative to the roller 33.

In accordance with further aspects of a preferred embodiment, the roller 33 is removed from the support section 34 so that the adhesive roll 31 can be more easily slid on and off the support section 34. With this embodiment, the roller and adhesive tape roll 31 are removed from the handle 30 so that a new adhesive roll may be inserted on the roller. The roller is then put back into the handle.

The adhesive tape roll 31 is a pressure sensitive adhesive tape and can consist of a saturated release coated crepe paper, pulled out paper, flat back paper or can be fabricated utilizing a flexible washable plastic substrate of poly vinyl or other suitable washable plastic sheet material having a washable pressure sensitive adhesive coating provided on one side thereof. The adhesive coating provided on the flexible plastic substrate can also be a water base poly vinyl acetate so as to be washable so that each layer of tape can be used several times before being detached and discarded as hereinafter described.

In use, the lint remover assembly 10 is selectively rolled over the surface to be cleaned so that the outer adhesive surface of the tape roll 30 removes the lint, dust and foreign particles therefrom as they adhere thereto. After the outer surface becomes saturated through repeated use, the outer used layer can be removed. This is initially accomplished by lifting the corner of the leading edge of the tape roll 30 and pulling the used layer away from the tape roll 30 so as to expose the unused adhesive tape layer therebelow.

After the used layer is thus removed, the lint remover 10 is ready for use until the newly exposed tape layer is similarly saturated. The foregoing process is repeated until the entire tape roll is expended. A new refill tape roll is selectively installed on the roller assembly as desired.

In the preceding specification, the invention has been described with reference to specific exemplary embodiments thereof. It will however, be evident that various modifications and changes may be made thereto without departing from the broader spirit and scope of the invention as set forth in the claims that follow. The specification and drawings are accordingly to be regarded in an illustrative manner rather than a restrictive sense.

What is claimed is:

1. A lint roller comprising:

a handle;

a roller; said roller having two distal ends, said distal ends including a protrusion, said distal ends and said protrusions lying generally along an X-plane;

a substantially U-shaped roller support section located on an inner part of said handle; the roller support section including a groove section;

an adhesive tape roll covering said roller; and a cover arranged to interconnect with the handle, said cover being completely removable and separable from said handle, the handle and cover being substantially similar, whereby said protrusion removably locks into said groove section, said protrusions extending beyond said roller support section, said protrusions having a circular portion that is coplanar with said X-plane.

2. The lint roller of claim 1 whereby the roller, the roller support section and the adhesive tape roll are contained within the handle and cover when said handle and cover are in a closed position.

3. The lint roller of claim 1 whereby the handle and cover are oval.

4. The lint roller of claim 1 whereby said roller support section supports the roller within the handle.

5. The lint roller of claim 1 whereby said adhesive tape roll is removable from said roller.

6. The lint roller of claim 1 whereby the adhesive tape roll includes a number of adhesive sheets wound on a core.

7. The lint roller of claim 1 whereby the roller includes a flexible washable plastic substrate of polyvinyl.

8. The lint roller of claim 1 whereby said protrusions are removably connected to said roller support section.

9. The lint roller of claim 1 whereby lint is removed from an article of clothing by rolling the lint roller on the article of clothing.

10. The lint roller of claim 1 whereby the adhesive tape roll is changed by removing the roller from the handle and withdrawing the roller from said adhesive tape roll, thereby allowing a new tape roll to be sheathed on the roller.

11. A lint roller comprising:

a handle;

a roller, said roller having two distal ends, said distal ends including a protrusion said distal ends and said protrusions lying generally along an X-plane;

a roller support section located on an inner part of said handle, the roller support section including a groove section, the groove section being substantially U-shaped;

an adhesive tape roll covering said roller; and a cover arranged to interconnect with the handle, the handle and cover being substantially similar, whereby said protrusion removably locks into said groove section, said protrusions extending beyond said roller support section, said protrusions having a circular portion that is coplanar with said X-plane.

12. The lint roller of claim 11 whereby the roller, the roller support section and the adhesive tape roll are contained within the handle and cover when said handle and cover are in a closed position.

13. A lint roller comprising:

a handle;

a roller, said roller having two distal ends, said distal ends including a protrusion said distal ends and said protrusions lying generally along an X-plane;

a roller support section located on an inner part of said handle, the roller support section including a groove section, the groove section being substantially U-shaped;

an adhesive tape roll covering said roller; and a cover arranged to interconnect with the handle, said cover being completely removable and separable from said handle, and the handle and cover being substantially similar, whereby said protrusion removably locks into said groove section, said protrusions extending beyond said roller support section, said protrusions having a circular portion that is coplanar with said X-plane.

14. The lint roller of claim 13 whereby the roller, the roller support section and the adhesive tape roll are contained within the handle and cover when said handle and cover are in a closed position.

* * * * *

UNITED STATES PATENT AND TRADEMARK OFFICE

CERTIFICATE OF CORRECTION

PATENT NO. : 7,111,351 B1
APPLICATION NO. : 11/105630
DATED : September 26, 2006
INVENTOR(S) : Flavio DeRoma It is certified that error appears in the above-identified patent and that said Letters Patent is hereby corrected as shown below:

Title Page item 73
Assignee is not listed in the patent.

The Assignee is: Kaminstein Imports, Inc.
400 Corporate Drive
Blauvelt, New York 10913

Signed and Sealed this

Twenty-seventh Day of November, 2007

JON W. DUDAS
*Director of the United States Patent and Trademark Office*